US008789576B2

(12) United States Patent
Krueger et al.

(10) Patent No.: US 8,789,576 B2
(45) Date of Patent: Jul. 29, 2014

(54) FIRE OR SMOKE PROTECTION DEVICE

(75) Inventors: Frank Krueger, Bad Harzburg (DE); Christian Meier, Bad Harzburg (DE); Frank Ottmers, Langelsheim (DE); Stefan Siller, Lutter am Barenberge (DE); Stefan Tappe, Liebenburg 5 (DE)

(73) Assignee: Stoebich Brandschutz GmbH, Goslar (DE)

( * ) Notice: Subject to any disclaimer, the term of this patent is extended or adjusted under 35 U.S.C. 154(b) by 5 days.

(21) Appl. No.: 13/439,086

(22) Filed: Apr. 4, 2012

(65) Prior Publication Data

US 2012/0255684 A1 Oct. 11, 2012

(30) Foreign Application Priority Data

Apr. 6, 2011 (DE) ..... 10 2011 016 266

(51) Int. Cl.
*E06B 9/56* (2006.01)

(52) U.S. Cl.
USPC ..... 160/291; 160/23.1; 160/300; 160/133

(58) Field of Classification Search
USPC ..... 160/23.1, 133, 29, 300–304.1, 323.1, 160/324, 325, 326, 291
See application file for complete search history.

(56) References Cited

U.S. PATENT DOCUMENTS

| | | | | | |
|---|---|---|---|---|---|
| 717,231 | A * | 12/1902 | Lowry | 126/546 |
| 842,968 | A * | 2/1907 | McCloud | 160/1 |
| 1,171,215 | A * | 2/1916 | Lane | 160/300 |
| 1,242,177 | A * | 10/1917 | Gumber | 160/23.1 |
| 1,709,271 | A * | 4/1929 | McCloud et al. | 160/7 |
| 1,882,623 | A * | 10/1932 | Kasper | 160/299 |
| 3,819,217 | A * | 6/1974 | Savino | 292/345 |
| 3,882,921 | A * | 5/1975 | Sandall | 160/266 |
| 4,597,430 | A * | 7/1986 | Marquez | 160/269 |
| 5,070,925 | A * | 12/1991 | Paule | 160/133 |
| 5,199,594 | A | 4/1993 | Obara et al. | |
| 5,263,527 | A * | 11/1993 | Marlatt et al. | 160/7 |
| 5,443,107 | A * | 8/1995 | Kraler | 160/133 |
| 5,474,117 | A * | 12/1995 | Henkenjohann | 160/133 |
| 5,544,690 | A * | 8/1996 | Magro et al. | 160/133 |
| 5,613,539 | A * | 3/1997 | Kraler | 160/32 |
| 5,862,851 | A * | 1/1999 | Stoebich et al. | 160/121.1 |
| 5,996,670 | A * | 12/1999 | Igarashi | 160/133 |
| 6,390,171 | B2 * | 5/2002 | Drifka et al. | 160/23.1 |
| 6,427,749 | B1 * | 8/2002 | Swink et al. | 160/188 |

(Continued)

FOREIGN PATENT DOCUMENTS

| | | |
|---|---|---|
| DE | 1 906 543 | 8/1970 |
| GB | 735201 | 8/1955 |
| GB | 2 077 099 | 12/1981 |
| GB | 2416991 A | 2/2006 |

*Primary Examiner* — Katherine Mitchell
*Assistant Examiner* — Johnnie A Shablack
(74) *Attorney, Agent, or Firm* — Whitham Curtis Christofferson & Cook, PC

(57) ABSTRACT

A fire or smoke protection device (12) with a flexible partition device (16) which can be put in a protection arrangement in which the partition element (16) can work to its full protective effect, and a storage arrangement, and a winding shaft (18) upon which the partition element (16) is wound up in the storage arrangement, and a mounting device (20) for fixing the fire or smoke protection device (10) on a building section (14), wherein at least one anchoring device (22) positively interacts with the winding shaft (18) if and only if the partition element (16) is in the protection arrangement.

9 Claims, 5 Drawing Sheets

(56) References Cited

U.S. PATENT DOCUMENTS

Figures 1, 1A, 1B, 1C, 1D:
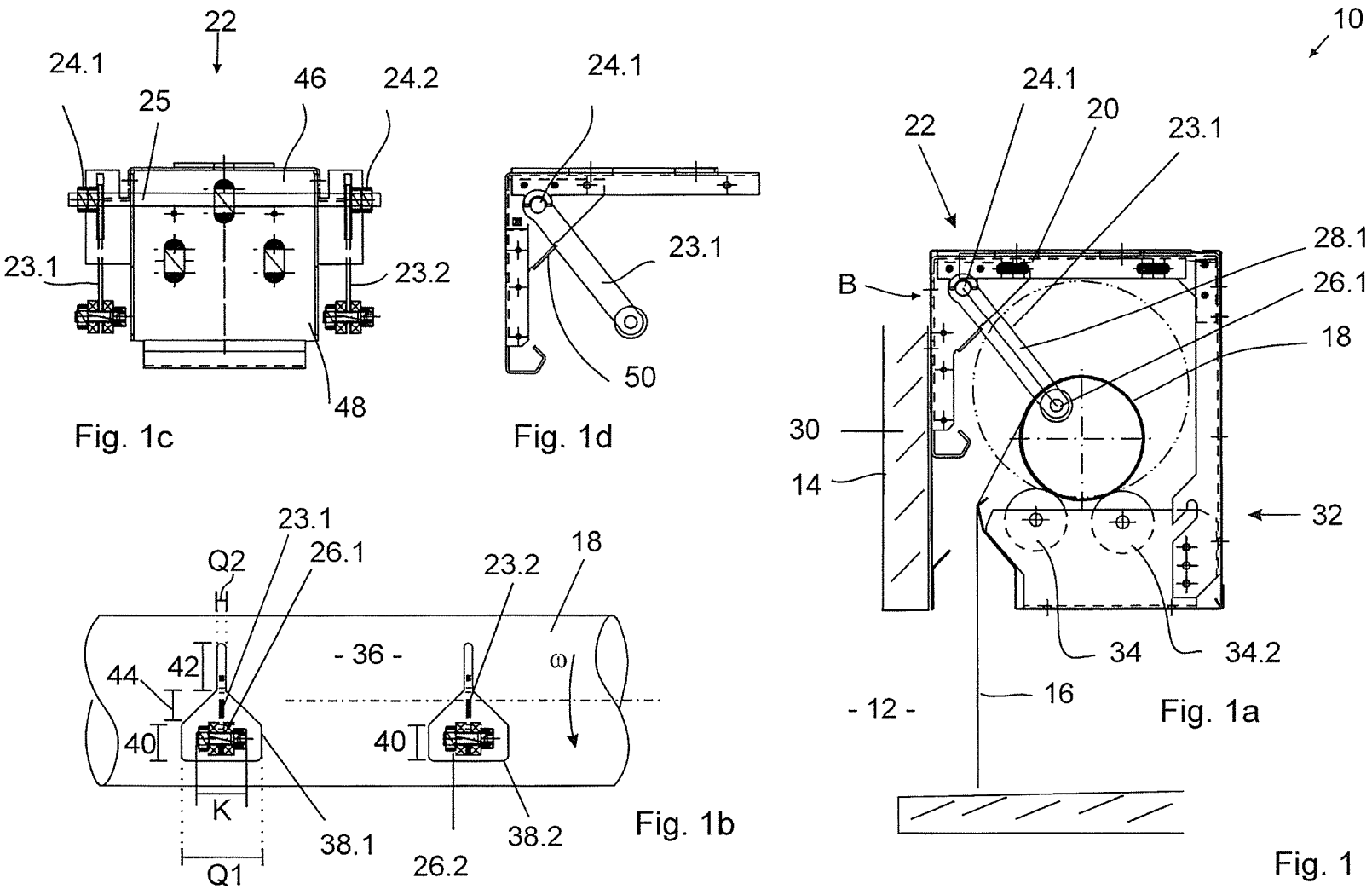

| | | | | |
|---|---|---|---|---|
| 6,986,378 | B2 * | 1/2006 | Beaudoin et al. | 160/191 |
| 7,311,131 | B2 * | 12/2007 | Nien et al. | 160/121.1 |
| 7,617,858 | B2 * | 11/2009 | Hoffmann et al. | 160/11 |
| 7,886,805 | B2 * | 2/2011 | Svenson | 160/315 |
| 7,918,263 | B2 * | 4/2011 | Kraeutler | 160/23.1 |
| 8,006,736 | B2 * | 8/2011 | Hoffmann et al. | 160/238 |
| 8,113,266 | B2 * | 2/2012 | Cloninger et al. | 160/310 |
| 8,235,087 | B2 * | 8/2012 | Svenson | 160/133 |
| 8,272,425 | B2 * | 9/2012 | Coenraets | 160/273.1 |
| 8,333,229 | B2 * | 12/2012 | Kimener | 160/23.1 |
| 8,397,787 | B1 * | 3/2013 | Daus et al. | 160/9 |
| 2006/0037718 | A1 * | 2/2006 | Coenraets | 160/133 |
| 2006/0090860 | A1 * | 5/2006 | Corboy | 160/133 |
| 2006/0231215 | A1 * | 10/2006 | Loo | 160/133 |
| 2006/0272783 | A1 * | 12/2006 | Smith et al. | 160/121.1 |
| 2011/0265959 | A1 * | 11/2011 | Frede | 160/133 |
| 2012/0193040 | A1 * | 8/2012 | Colson et al. | 160/133 |

* cited by examiner 10
28.1
26.1
18
32
23.1
20
24.1
22
B
30
14
34.2
34
16
- 12 -

24.1
23.1
50

24.2
23.2
46
48
22
25
24.1
23.1

18
ω
23.2
38.2
26.2
40
- 36 -
23.1
26.1
38.1
Q2
42
44
40
K
Q1

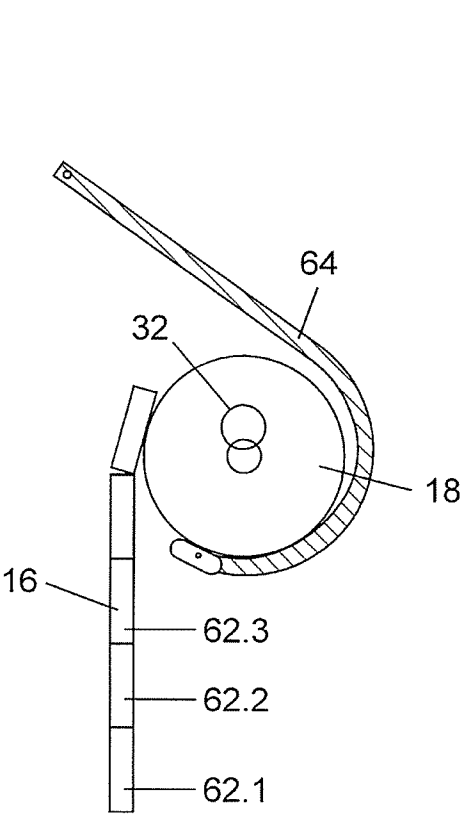
Fig. 5c
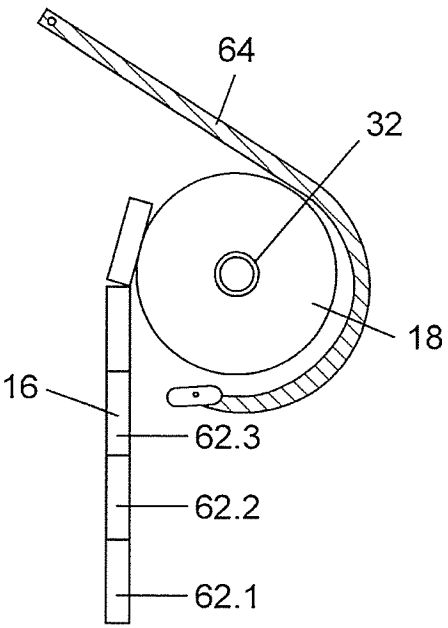
Fig. 5b
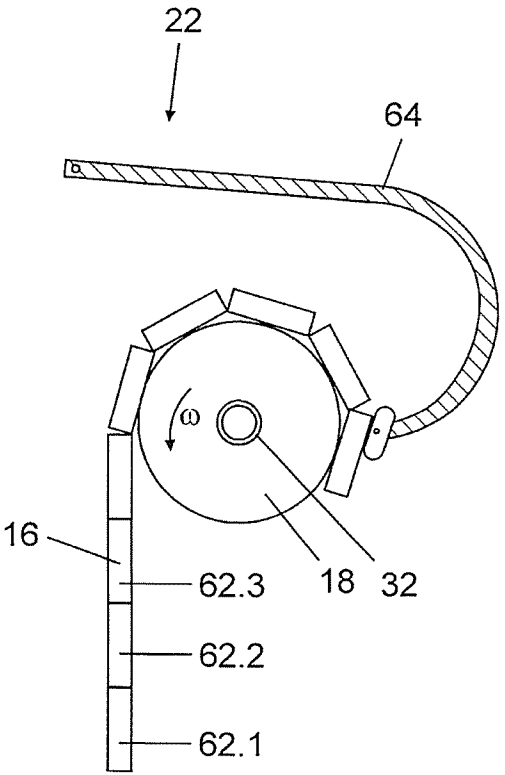
Fig. 5a
Fig. 5

FIRE OR SMOKE PROTECTION DEVICE

The invention relates to a fire or smoke protection device, to be used particularly to seal a building opening with (a) a flexible partition element, (b) a winding shaft to wind up the partition element and (c) a mounting device for fixing the fire or smoke protection device to a building section.

These types of fire or smoke protection devices, for example fire protection rolling shutters or fire curtains, are used to seal off a building opening in the event of a fire, so that a fire on one side of the building opening cannot spread to the other side for a given period of time. These types of fire or smoke protection devices may also be smoke curtains which hinder the spread of smoke. In order to be able to seal particularly wide building openings or to hinder the spread of smoke on a broad scale, correspondingly wide fire or smoke protection devices are necessary. In the event of a fire, the heat can cause defaults, which challenge the sealing effect of the fire or smoke protection device.

The invention aims to improve the sealing security of fire and smoke protection devices.

The invention solves the problem by means of a fire or smoke protection device according to the preamble, which comprises an anchoring device. The anchoring device is formed in such a way that it interacts positively with the winding shaft and anchors the winding shaft if and only if the partition element seals the building opening.

The advantage of a fire or smoke protection device of this type is that the anchoring device also holds the winding shaft in place if, for example, the mounting device has become completely deformed due to high temperatures during a fire.

A further advantage is that the anchoring device can comprise a number of anchoring elements, each of which positively interacts with the winding shaft and prevents the winding shaft from becoming deformed beyond a tolerable extent. It is even tolerable for the mounting device to become extremely deformed and the winding shaft to be fixed exclusively by the anchoring device. This means that the mounting device can be made from a small amount of temperature-resistant material, which reduces the space needed for the construction.

A further advantage of the invention is that it is technically simple to achieve the securing effect of the anchoring device. Due to the fact that the anchoring device has a simple construction, device failure is largely excluded.

Within the scope of the present description, the term fire or smoke protection device may be understood to mean every device which is designed to significantly delay or prevent the spread of a fire or smoke when it is in the protection arrangement. In particular, the fire or smoke protection device is a fire protection device and designed to resist a fire for at least 30 minutes. The specifications for fire or smoke protection devices are, for example, stated in DIN. The fire or smoke protection device corresponds specifically to the requirements of DIN EN 1634-1 or DIN EN 12101-1. The fire or smoke protection device can, for example, be a protective rolling shutter, a fire protection closure, a fire curtain or a smoke curtain.

The term storage arrangement may be understood to mean an arrangement in which the partition element is wound up. The fire or smoke protection device then takes up a small amount of space. The fire or smoke protection device is normally in the storage arrangement, but in the event of a fire it is in the protection arrangement. In particular, if the fire or smoke protection device is designed to seal a building in the event of a fire, as in a preferred embodiment, the protection arrangement can also be referred to as a sealing arrangement.

The term partition element may be understood to mean an element which is flame-retardant and flexible. It should be noted that a flexible partition element, i.e. a pliable partition element, does not necessarily have to be elastic. The partition element can thus comprise, for example, a number of segments that are connected to each other by hinges, which form a roller blind, wherein the end element is flexible, but generally not elastic.

The term winding shaft may be understood to mean a structure that can be rotated about its longitudinal axis, which is constructed in such a way that the partition element can be wound up around it. It is possible, although not necessary, for the winding shaft to be completely cylindrically shaped. For example, it can be sufficient for the winding shaft to have cylindrical sections, so that the partition element can be wound up.

The term mounting device may be understood to mean every device that can introduce gravitational force acting on the winding shaft into the building. It is possible, although not necessary, for the mounting device to be designed as a housing, at least partially surrounding the winding shaft.

The term anchoring device may be understood to mean a device that prevents the winding shaft from falling down if a bearing device is disturbed, the bearing device being a device which acts as a mount for the winding shaft. It is possible, although not necessary, for the anchoring device to constantly bear a proportion of the weight. It is thereby possible for the anchoring device to be designed in such a way that it only bears a significant proportion, for example more than 20%, of the weight of the winding shaft and/or partition element during a failure of the bearing device which normally acts as a mount for the winding shaft. In other words, the anchoring device can be designed in such a way that it bears at least part of the weight of the winding shaft and partition element only if the bearing device of the winding shaft is so damaged by a fire that it gives way. When the bearing device gives way like this, the winding shaft moves downwards until a further downward movement is prevented by the anchoring device.

It is possible, although not necessary, for the anchoring device to be connected to the mounting device. It is also possible that the anchoring device is designed to be directly connected with the building section comprising the building opening. However, the fire or smoke protection device has a particularly simple construction if the anchoring device is fixed to the mounting device.

It is favorable if the winding shaft has a width of at least 10 meters. The invention is also advantageous for shorter winding shafts, but the advantages of the invention are particularly marked with longer winding shafts.

It is favorable if the anchoring device is designed to introduce a weight of at least the winding shaft in the form of a traction force. In other words, the anchoring device is designed in such a way that the winding shaft hangs on it, particularly if the bearing device of the winding shaft no longer supports or holds it. This means that the anchoring device does not carry the winding shaft, but rather holds it, if necessary.

According to a preferred embodiment, the winding shaft is at least partially cylindrically formed and comprises a cylinder shell, the winding shaft having at least one winding shaft recess on the cylinder shell and the anchoring device having at least one anchoring element which is designed to connect with the winding shaft recess. This connecting can be a purely passive process, which is thus intrinsically safe. As soon as the partition element is unwound far enough away from the winding shaft, the anchoring element connects with the winding shaft recess and forms a tight fit. It is possible, although not necessary, for the anchoring element to move within the winding shaft recess.

According to a preferred embodiment the at least one winding shaft recess is arranged in such a way that it is at least partially covered by the partition element when the partition element is in the storage arrangement, and not covered by the partition element when the partition element is in the protection arrangement. This means that the anchoring element cannot connect with the winding shaft as long as the partition element is not in the protective arrangement. As soon as the partition element is in the protection arrangement, the anchoring element connects with the winding shaft recess; this can be a passive process, which is thus intrinsically safe.

The partition element preferably comprises a partition element recess that is designed in such a way that the at least one anchoring element connects with the winding shaft recess via the partition element recess, and in particular moves when the partition element is in the protection arrangement.

Due to the fact that the partition element has a partition element recess, the area adjacent to the partition element recess also bears the weight of the partition element, so that the partition element can be fixed behind the winding shaft recess in relation to the direction of rotation of the winding shaft. This increases the stability with which the partition element is fixed to the winding shaft.

The partition element preferably has a number of partition element recesses and/or winding shaft recesses, which are distributed along a longitudinal axis of the winding shaft, the anchoring device having a number of anchoring elements that are designed to connect with each of the winding shaft recesses. The greater number of anchoring elements increases the likelihood that a sufficiently large number of anchoring elements connect with the recesses, which reduces the possibility of failure.

The fire or smoke protection device preferably comprises a bearing device on which the winding shaft is rotatably borne. In other words, the winding shaft can be situated on the bearing device. The bearing device then bears the compressive force by itself. A bearing device of this type is particularly simple to make. The disadvantage of this type of bearing device, namely the sensitivity against thermal distortions and the accompanying risk—that the fire or smoke protection device or pinion shaft does not securely seal the building opening in the event of a fire—is excluded by the presence of the anchoring device. This results in a secure fire or smoke protection device which is simultaneously simple to construct and install.

According to a preferred embodiment, at least some of the anchoring elements comprise a head, providing a means of contact of the respective anchoring element to the partition element, and an arm on which the head is fixed, wherein the at least one winding shaft recess has a first section with a first clear cross-section and a second section with a second clear cross-section, the first clear cross-section being larger than the head width, so that the head connects with the winding shaft recess when the head reaches the winding shaft recess, and the second clear cross-section being smaller than the head width, so that the head can be caught in the winding shaft recess. With regards to the direction of rotation of the winding shaft when the partition element is taken out of its storage arrangement or protection arrangement, the first section is generally found in front of the second section. The head thus slides initially through the first section and then into the second section, which it cannot leave.

The clear cross-section of the winding shaft recess preferably decreases monotonically during the transition from the first section to the second section.

The head preferably comprises a sliding element, in particular a roller, along which the head slides along the partition element, particularly when the partition element is wound up by the winding shaft.

It is preferable that at least one anchoring element is preloaded against the winding shaft. This can occur, for example, by means of a spring or gravity. It is then ensured that the anchoring element connects with the winding shaft recess, and in particular moves when the partition element is in the protection arrangement.

The fire or smoke protection device is preferably a roller shutter and the partition element comprises a vertical shutter made from flexibly joined slat elements.

According to a preferred embodiment, the anchoring device comprises an arrestor hook which does not engage with the winding shaft when the partition element is not in the protection arrangement, and which interacts positively with the winding shaft when the partition element is in the protection arrangement in such a way that the arrestor hook at least partially encompasses the winding shaft.

According to the invention, a building also has a building opening, on which the fire or smoke protection device according to the invention is arranged.

In the description, the words 'a' or 'an' are used as indefinite articles and not as numerals. It is therefore possible that a corresponding item is only present, but not necessary.

Figure 1E:
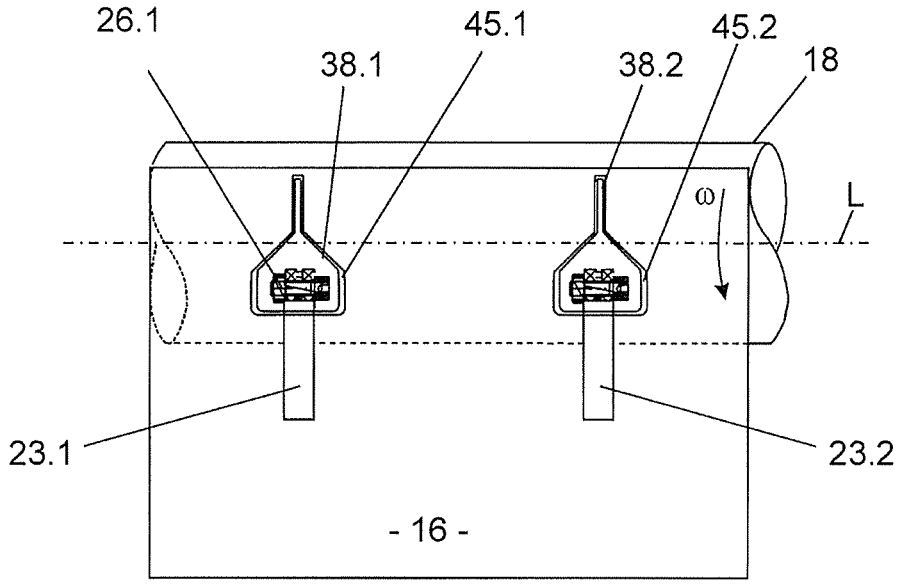
Figure 1F:
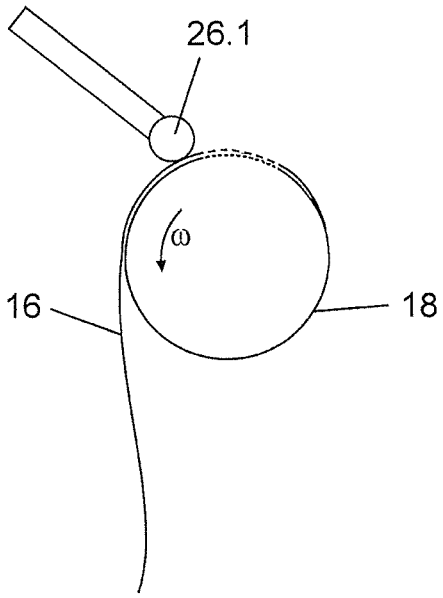
Figure 1G:
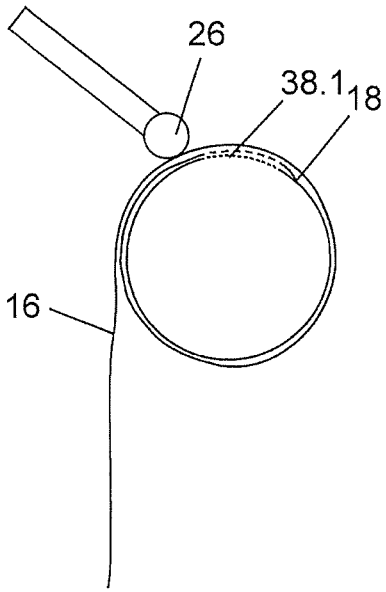
Figure 2:
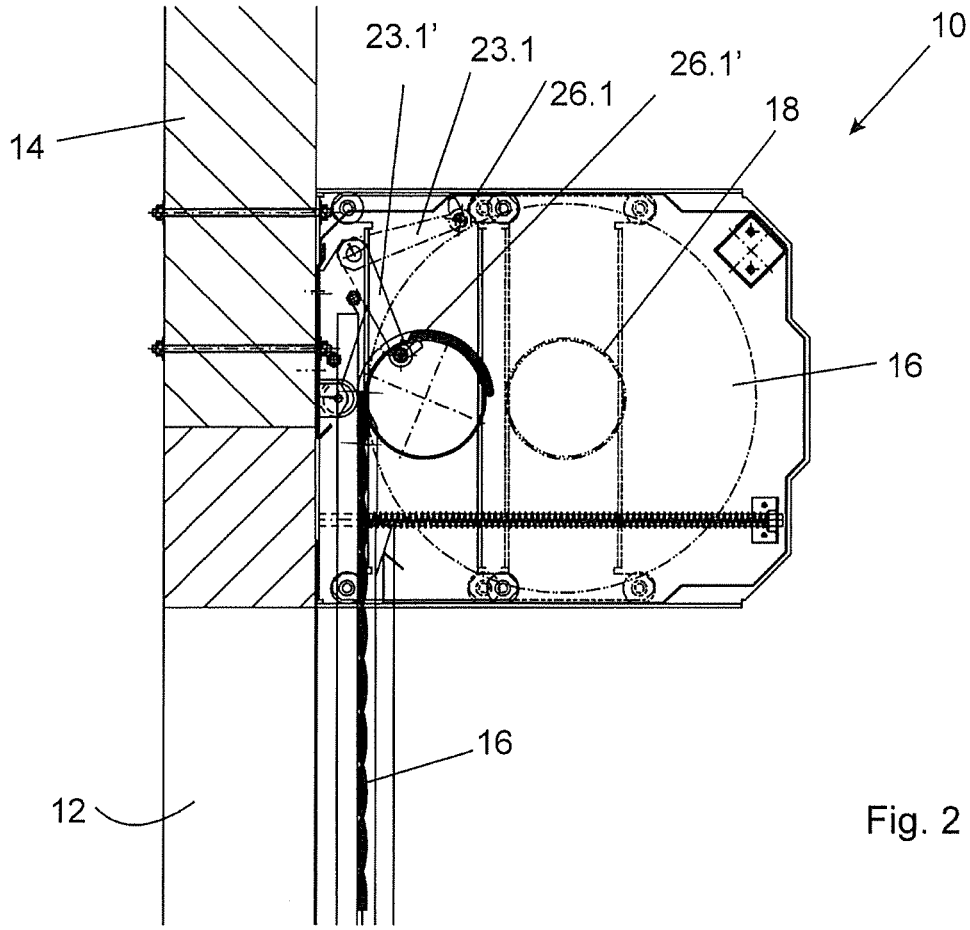
Figure 3:
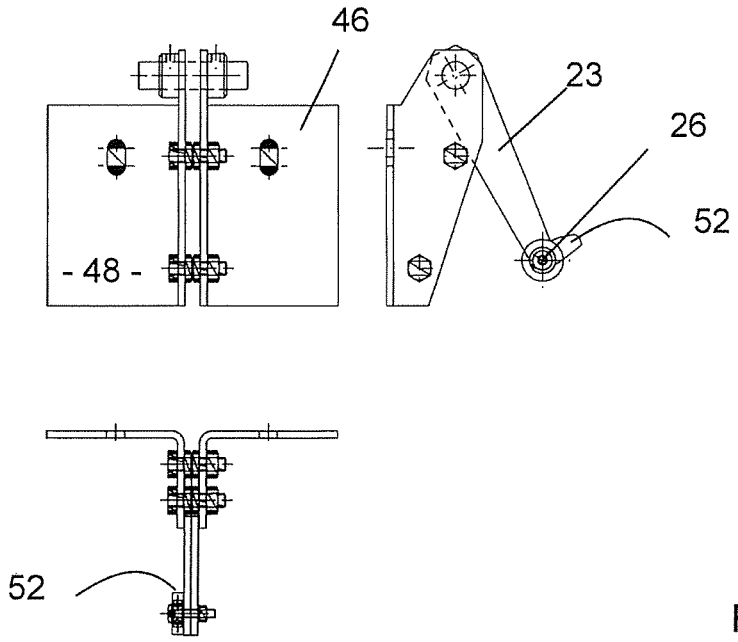
Figures 4, 4A, 4B, 4C:
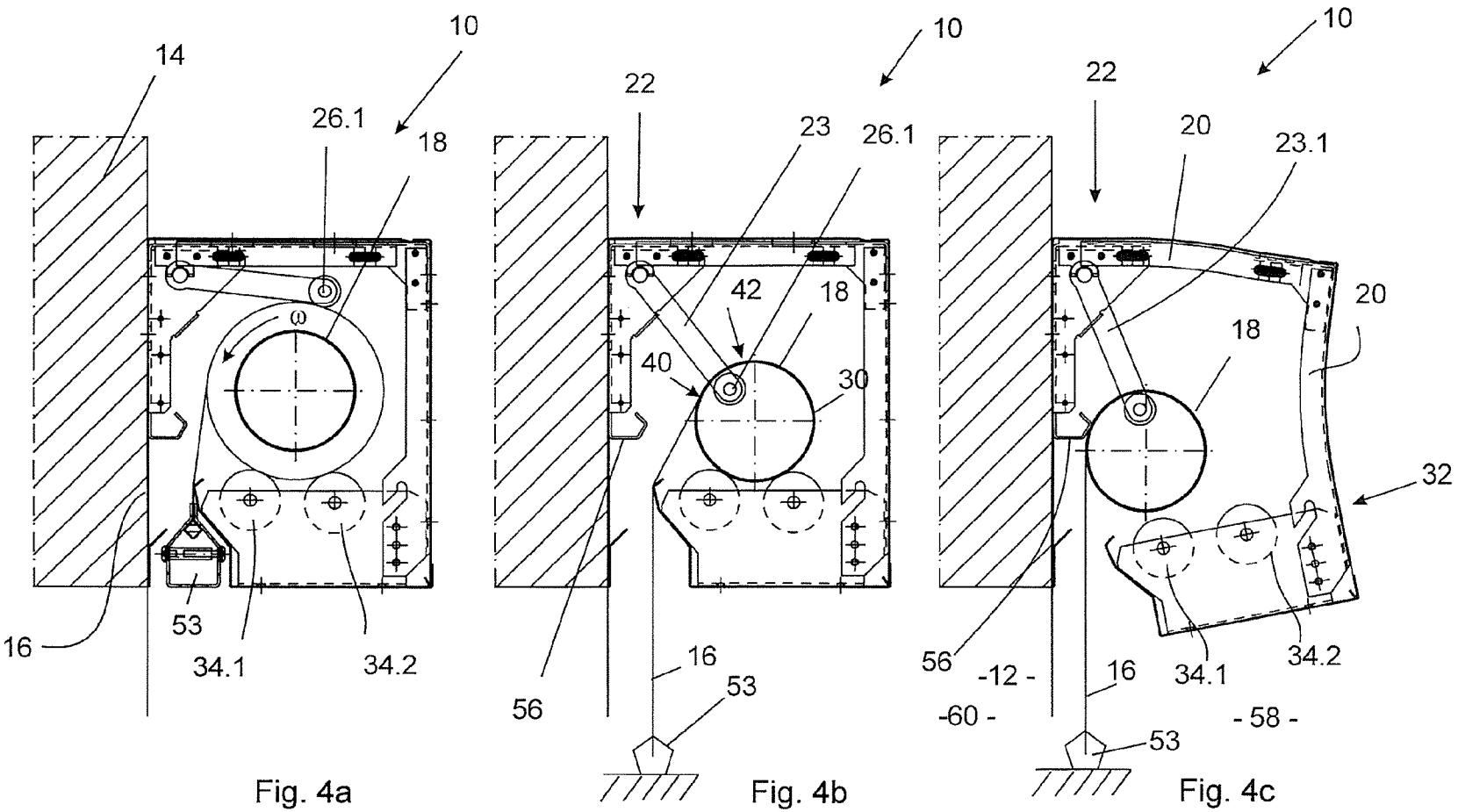

In the following, the invention will be explained in more detail with the aid of the attached drawings. What is shown is:

In FIG. 1's section FIG. 1*a* a cross section through a smoke protection device according to the invention, section FIG. 1*b* a view of a winding shaft, section FIG. 1*c* an anchoring device of the fire or smoke protection device, section FIG. 1*d* the anchoring device according to section FIG. 1*c* from a side-on view, section FIG. 1*e* a top view of the winding shaft, in which the winding shaft recess and the partition element recess are visible, and in section FIG. 1*f* the winding shaft from section FIG. 1*e* from a side-on view, section FIG. 1*g* the side-on view from section FIG. 1*f* with a partially wound up partition element, in FIG. 2 another cross-sectional view through the fire or smoke protection device according to the invention, in FIG. 3 an anchoring device from three perspectives, in FIG. 4 with section FIGS. 4*a*, 4*b* and 4*c* a fire or smoke protection device in the storage arrangement (FIG. 4*a*), in the protection arrangement (FIG. 4*b*) and in a thermally distorted state (FIG. 4*c*) and in FIG. 5 with section FIGS. 5*a* and 5*c* a fire or smoke protection device according to the invention in the form of a roller shutter.

FIG. 1 shows in the section FIG. 1*a* a fire or smoke protection device 10 according to the invention for sealing a building opening 12 of a schematically depicted building section 14, with a flexible partition element 16 made from fire resistant material in the present case a winding shaft 18 and a mounting device 20, by means of which the fire or smoke protection device 10 is fixed to a mounting side B on the building section 14.

In addition, the fire or smoke protection device 10 has an anchoring device 22, comprising an anchoring element 23.1 that is arranged, by means of hinges, in a base point 24.1 on the mounting device 20 and connects with a head 26.1 in a winding shaft recess, which is not visible in FIG. 1*a*. The head 26.1 is connected to the base point 24.1 via an arm 28.1.

FIG. 1*a* shows the partition element 16 in the protection arrangement, in which it seals the building opening 12. The partition element 16 is fixed to the winding shaft 18, for example with screws or adhesive, along a mounting line 30 that runs perpendicular to the paper plane.

The fire or smoke protection device 10 comprises a bearing device 32 which has a first bearing roller 34.1 and a second bearing roller 34.2. The winding shaft 16 is mounted on the bearing rollers 34 (references with no number suffix refer to the item in general) with the at least partially unwound partition element 16, if necessary. The bearing element 32 is the mounting device 20 in the present case.

FIG. 1*b* shows the winding shaft 18 from a top view. It should be recognised that the winding shaft 18 is cylindrical and has a cylinder shell 36. A first winding shaft recess 38.1 and a second winding shaft 38.2 are arranged in the cylinder shell 36. The winding shaft recesses each comprise a first section 40, which has a first clear cross-section Q1, and a second section 42 with a second clear cross-section Q2, which is separated from the first section 40 by a transition section 44. The clear-cross section decreases monotonically in the transition section 44.

FIG. 1*b* also shows the head 26.1 of the anchoring element 23.1. It should be recognised that the head width K of the head 26 is smaller than the first clear cross-section Q1 and larger than the second clear cross-section Q2. Should the winding shaft be thus rotated at a winding speed. ω, the head 26.1 catches in the first section 40 and catches behind the winding shaft 18 in the second section 42 of the winding shaft recess 38.1. FIG. 1*b* also shows a second anchoring element 23.2 with a head 26.2 that connects with the second winding shaft recess 38.2 in the same way.

FIG. 1*c* shows a mounting bracket 46 of the anchoring device. The mounting bracket comprises a base plate 48 on which the first anchoring element 23.1 and second anchoring element 23.2 are hinged in their respective base points 24.1, 24.2 and connected by a shaft 25.

FIG. 1*d* shows the anchoring element 23.1. It should be recognised that it is preloaded against the winding shaft 18 (cf. FIG. 1*a*) by means of a spring 50.

FIG. 1*e* shows a top view of the winding shaft 18 with a longitudinal axis L. It should be recognised that the partition element 16 has a partition element recess 45.1 that is designed in such a way that an anchoring element 23.1 reaches into the winding shaft recess 38.1 via the partition element recess 45.1 when the partition element is in the projection arrangement, as shown in section FIG. 1*e*. In the protection arrangement, the partition element recess 45.1 and the winding shaft recess 38.1 are situated above one another, so that the head 26.1 catches in both recesses 38.1, 45.1. A prior full rotation of the Winding shaft 18 brings the winding shaft recess 38.1 into the same angular position shown in section FIG. 1*e*, the winding shaft recess 38.1 then being covered by a layer of the partition element 16. The head 26.1 cannot then connect with the winding shaft recess 38.1.

In addition, the partition element 16 has a second partition element recess 45.2 that aligns with the winding shaft recess 38.2. The winding shaft 18 can have additional partition element recesses, not depicted here, in particular one for each winding shaft recess.

Section FIG. 1*f* shows a view of the situation in section FIG. 1*e* from the side. When the winding shaft 18 is rotated further the head 26.1 connects with the recess 38.1.

Section FIG. 1*g* shows the situation in which the partition element 16 is not in the protection arrangement and the winding shaft recess 38.1 is covered by the partition element 16. The head 26.1 cannot connect with the winding shaft recess 38.1. FIG. 2 shows the fire or smoke protection device 10 in two states, namely once in the protection arrangement (solid lines) and once in the storage arrangement (dash-dot-dot line). It should be recognised that the anchoring element 23.1 is situated with its head 26.1 on the unwound partition element 16 when it is in the storage arrangement. Should the partition element 16 be wound up by the winding shaft 18, the head 26.1 slides onto the partition element 16 and moves downwards. With the fire or smoke protection device shown in FIG. 2 the winding shaft 18 moves towards the building section 14.

Should the partition element 16 be in the protection arrangement, the anchoring element 23.1' (references with an apostrophe indicates the position of the item when the partition element is in the storage arrangement) connects with the winding shaft recess 38, not visible in FIG. 2, so that the head 26.1' interacts positively with the winding shaft recess and prevents it from unwinding further.

FIG. 3 shows a further embodiment of a mounting bracket 46 for a fire or smoke protection device according to the invention, the anchoring element 23 having a nose 52 on its head 26 which facilitates the entry into the winding shaft recess 38.

FIG. 4 shows in FIG. 4*a* the fire or smoke protection device 10 with the partition element 16 in the storage arrangement. It should be recognised that the head 26.1 is situated at the top of the partition element 16 wound onto the winding shaft 18. Should the partition element 16 be wound up with the winding speed ω, in this case in an anti-clockwise direction, the head 26.1 slides onto the partition element 16 covering the winding shaft recess 38, so that the head 26.1 cannot connect with it.

FIG. 4*b* shows the case when the partition element 16 is in the protection arrangement and in the present case is situated on the floor with a bottom rail 53. The head 26.1 has connected with the second section 42 of the winding shaft recess 38. In this arrangement, the head 26.1 is a short distance away from in the inner surface of the winding shaft 18. The anchoring device 22 is already interacting positively with the winding shaft 18, but the winding shaft 18 does not exert any force on the anchoring element 23.1 of the anchoring device 22.

FIG. 4*c* shows the case when the mounting device 20 has become so deformed from the effects of a fire that the bearing device 32 has detached itself from the winding shaft 18. The winding shaft 18 is now no longer situated on the bearing rollers 34.1, 34.2, but is instead held by the anchoring elements 23, in particular by anchoring element 23.1. The winding shaft 18 then exerts a pure traction force on the anchoring elements 23.

As is the general case in a preferred embodiment, the fire or smoke protection device 10 comprises a sealing strip 56 which, in the case that the winding shaft 18 is held by the anchoring device 22, is situated on the winding shaft and/or the partition element 16. This prevents smoke from passing from the first side 58 of the building opening 12 to the second side 60, so that the fire or smoke protection device 10 prevents smoke passing through the building opening.

FIG. 5*a* shows a fire or smoke protection device 10 according to the invention in the form of a rolling shutter, the partition element 16 constituting a vertical blind made up of slat elements 62.1, 62.2, . . . that are connected to each other by hinges. The slat elements 62 are fixed onto the winding shaft 18. The anchoring device 22 comprises an arrestor hook 64 which does not connect with the winding shaft 18 when the partition element 16 is not in the protection arrangement. For example, the arrestor hook then slides onto the vertical blind.

FIG. 5*b* shows the case in which the partition element 16 is in the protection arrangement. The arrestor hook 64 at least partially encompasses the winding shaft 18 and thus interacts positively with the winding shaft 18. In FIG. 5*b* the winding shaft 18 is held by the bearing device 32. The connection between the arrestor hook 64 and the winding shaft 18 is not activated and therefore there is no positive locking between them.

FIG. 5*c* shows the case in which the bearing device 32 can no longer hold the winding shaft 18 due to a distortion of the mounting device 20. The winding shaft 18 hangs on the arrestor hook 64 and there is positive locking between them.

Reference List

10 Fire or smoke protection device
12 Building, opening
14 Building section
16 Partition element
18 Winding shaft
20 Mounting device
22 Anchoring device
23 Anchoring element
24 Base point
25 Shaft
26 Head
28 Arm
30 Mounting line
32 Bearing device
34 Bearing roller
36 Cylinder shell
38 Winding shaft recess
40 First section
42 Second section
44 Transition section
45 Partition element recess
46 Mounting bracket
48 Base plate
50 Spring
52 Nose
53 Bottom rail
54 Housing
56 Sealing strip
58 First side
60 Second side
62 Slat element
64 Arrestor hook
Q1 First clear cross-section
Q2 Second clear cross-section
B Mounting side
K Head width
L Longitudinal axis
ω Winding speed

The invention claimed is:

1. A fire or smoke protection device comprising:

a flexible partition element that prevents the spread of fire or smoke when put in a protection arrangement and which is stored when put in a storage arrangement;

a winding shaft upon which the partition element is wound up in the storage arrangement and wound off in the protection arrangement;

a mounting device for mounting the fire or smoke protection device on a building section;

at least one anchoring device which directly engages with the winding shaft only if the partition element is in the protection arrangement; and a bearing device on which the winding shaft is rotatably supported, and the bearing device being mounted to the mounting device, wherein the winding shaft is supported by the at least one anchoring device to prevent the winding shaft from falling when the bearing device of the winding shaft no longer supports or holds the winding shaft or when the mounting device has become deformed due to high temperatures during a fire.

2. The fire or smoke protection device according to claim 1, wherein the winding shaft is at least partially cylindrical and has a cylinder shell and has a winding shaft recess in the cylinder shell, wherein the at least one anchoring device has at least one anchoring element which connects with the winding shaft recess, and wherein the at least one anchoring element is preloaded against the winding shaft.

3. The fire or smoke protection device according to claim 1, wherein the partition element encompasses a vertical blind.

4. The fire or smoke protection device according to claim 1, wherein the winding shaft is at least partially cylindrical and has a cylinder shell and has a winding shaft recess in the cylinder shell, wherein the at least one anchoring device has at least one anchoring element which connects with the winding shaft recess, and wherein the partition element has a partition element recess which is arranged in such a way that the at least one anchoring element enters through the partition element recess and into the winding shaft recess, when the partition element is in the protection arrangement.

5. The fire or smoke protection device according to claim 4, wherein the partition element has a number of partition element recesses which are distributed along a longitudinal axis of the winding shaft, and wherein the anchoring device has a number of anchoring elements which are designed to connect with each of the winding shaft recesses.

6. The fire or smoke protection device according to claim 1, wherein the winding shaft is at least partially cylindrical and has a cylinder shell and has a winding shaft recess in the cylinder shell, and wherein the at least one anchoring device has at least one anchoring element which connects with the winding shaft recess.

7. The fire or smoke protection device according to claim 6, wherein the at least one winding shaft recess is arranged in such a way that the at least one winding shaft recess is covered by the partition element when the partition element is in the storage arrangement, and the at least one winding shaft recess is not covered by the partition element when the partition element is in the protection arrangement.

8. The fire or smoke protection device according to claim 6, wherein the at least one anchoring element has a head, the head providing contact between the anchoring element and the partition element, and an aim on which the head is fixed, wherein the winding shaft recess has a first section with a first cross-section (Q1) and a second section with a second cross-section (Q2), and wherein the first cross-section (Q1) is larger than a head width (K) of the head so that the head connects with the winding shaft recess when the head reaches the winding shaft recess, and the second cross-section (Q2) is smaller than the head width (K), so that the head can catch in the winding shaft recess.

9. A building comprising a building opening, and a fire or smoke protection device in said building opening comprising:

a flexible partition element that prevents the spread of fire or smoke when put in a protection arrangement and which is stored when put in a storage arrangement;

a winding shaft upon which the partition element is wound up in the storage arrangement and wound off in the protection arrangement;

a mounting device for mounting the fire or smoke protection device on a building section;

at least one anchoring device which directly engages with the winding shaft only if the partition element is in the protection arrangement; and a bearing device on which the winding shaft is rotatably supported, and the bearing device being mounted to the mounting device, wherein the winding shaft is supported by the at least one anchoring device to prevent the winding shaft from falling when the bearing device of the winding shaft no longer supports or holds the winding shaft or when the mounting device has become deformed due to high temperatures during a fire, and whereby the mounting device is fixed on a mounting side onto the building, the at least one anchoring device being fixed adjacent to the mounting side of the mounting device.

* * * * *